US007527079B2

(12) United States Patent
Wadium et al.

(10) Patent No.: US 7,527,079 B2
(45) Date of Patent: May 5, 2009

(54) METHOD AND APPARATUS FOR FACILITATING FILLING A CONTAINER

(75) Inventors: Christopher Stephan Wadium, Salt Lake City, UT (US); David Loyd Sorensen, Sherwood, OR (US); Jeffrey Edward Kopish, Park City, UT (US); Benjamin Bradly Petersen, Tooele, UT (US); R. Phillip Vanausdal, Salt Lake City, UT (US); Kenneth David Goodworth, Grantsville, UT (US)

(73) Assignee: Graphic Packaging International, Inc., Marietta, GA (US)

( * ) Notice: Subject to any disclaimer, the term of this patent is extended or adjusted under 35 U.S.C. 154(b) by 571 days.

(21) Appl. No.: 11/210,385

(22) Filed: Aug. 24, 2005

(65) Prior Publication Data

US 2007/0051425 A1 Mar. 8, 2007

(51) Int. Cl.
*B65B 43/42* (2006.01)

(52) U.S. Cl. ..... 141/166; 141/165; 141/168; 53/571; 53/384.1; 198/468.4; 198/803.5

(58) Field of Classification Search ..... 141/165, 141/166, 171, 168; 53/570, 571, 384.1, 403; 198/468.4, 471.1, 867.03, 803.5
See application file for complete search history.

(56) References Cited

U.S. PATENT DOCUMENTS 3,702,625 A * 11/1972 Schmidt ..... 141/1
3,830,038 A * 8/1974 Propst ..... 53/77
4,037,387 A * 7/1977 Orikawa ..... 53/459
4,351,141 A 9/1982 Glorfield et al.
4,467,847 A * 8/1984 Zodrow ..... 141/98
4,864,801 A 9/1989 Fallas
5,155,967 A 10/1992 Branson
5,182,898 A * 2/1993 Tung et al. ..... 53/570
5,611,647 A * 3/1997 Ouellette ..... 406/88
5,651,235 A 7/1997 Ashley et al.
6,089,283 A 7/2000 Sienerth et al.
6,182,718 B1 2/2001 Seaton
6,332,484 B1 * 12/2001 Stahlecker et al. ..... 141/129
6,357,490 B1 3/2002 Johnston et al.
6,523,328 B1 * 2/2003 De Cardenas et al. ..... 53/399
6,644,519 B2 11/2003 Last (Continued)

*Primary Examiner*—Timothy L Maust
*Assistant Examiner*—Jason K Niesz
(74) *Attorney, Agent, or Firm*—Womble Carlyle Sandridge & Rice, PLLC

(57) ABSTRACT

Apparatus for delivering a plurality of containers to a plurality of filling machines for filling of the containers with a substance. The apparatus includes a feeding assembly including a first staging area aligned with a first filling machine of the plurality of filling machines for facilitating delivery of containers of the plurality of containers from the first staging area to the first filling machine, a second staging area aligned with a second filling machine of the plurality of filling machines for facilitating delivery of containers of the plurality of containers from the second staging area to the second filling machine, and a receiving area adjacent a supply of the plurality of containers. The feeding assembly is configured to move containers of the plurality of containers from the receiving area to the first staging area and to move containers of the plurality of containers from the receiving area to the second staging area. Each of the first and second staging areas is configured to receive containers of the plurality of containers from the receiving area.

25 Claims, 11 Drawing Sheets

U.S. PATENT DOCUMENTS 6,715,259 B2 4/2004 Johnston et al.
6,848,235 B2 2/2005 Savage et al.
6,892,768 B1 5/2005 Ours et al.
6,910,313 B2 6/2005 De Cardenas et al.
6,932,124 B2 8/2005 Dalton et al.
7,284,303 B2 * 10/2007 Canegallo et al. ..... 24/30.5 R
2004/0168412 A1 * 9/2004 Greening et al. ..... 53/570

* cited by examiner

METHOD AND APPARATUS FOR FACILITATING FILLING A CONTAINER

BACKGROUND OF THE INVENTION

This invention relates generally to containers, and more specifically to apparatus, assemblies, and methods for facilitating filling containers with a substance.

At least some known methods of filling empty containers with a substance, for example filling empty bags with starch, sugar, dry chemicals, cement, or concrete mix, are sometimes more difficult, costly, and time-consuming than may be desired. In commercial operations where numerous filling machines are used to fill as many empty containers in as short a time as possible, it may be particularly challenging to feed containers to each of the filling machines as quickly as they are filled. Accordingly, a potential production rate of the filling machines may not be achieved because of a bottleneck of containers fed to the filling machines. For example, at least some known systems for filling empty bags with concrete mix use one feeding machine to feed empty bags to numerous filling machines. Accordingly, the filling machines may sometimes fill each empty bag with concrete faster than empty bags are fed thereto, possibly decreasing an overall production of bags filled with concrete mix. Some known systems for filling empty bags with concrete mix use a dedicated feeding machine for each filling machine. However, such systems using a dedicated feeding machine for each filling machine may supply each feeding machine from a separate supply of empty bags, thereby possibly increasing a cost and/or a complexity of supplying the empty bags as well as possibly decreasing an amount of space adjacent the filling machines.

Moreover, at least some known containers may be difficult to open and/or maintain open for filling thereof, possibly increasing a cost and/or complexity of feeding machines used to feed containers to the filling machines. For example, bags used to contain concrete mix may be folded generally flat for storage when empty. Such bags sometimes include an opening adjacent an end thereof for filling the bag with concrete mix. When such bags are folded generally flat, the opening may be closed. When a feeding machine feeds an empty bag to a filling machine, the feeding machine may therefore open (and maintain) the opening as it delivers the empty bag to the filling machine so a dispenser on the filling machine communicates with the opening to fill the bag with concrete mix. At least some known systems use a pneumatically or hydraulically driven claw to both grip an empty bag for delivery of the bag to a filling machine and maintain the opening. However, such pneumatically or hydraulically driven claws may increase a cost and complexity of the system. At least some known systems may also use an insert, which may also be pneumatically or hydraulically driven, to initially open the opening, possibly further increasing a cost and complexity of the system.

BRIEF DESCRIPTION OF THE INVENTION

In one aspect, apparatus is provided for delivering a plurality of containers to a plurality of filling machines for filling of the containers with a substance. The apparatus includes a feeding assembly including a first staging area aligned with a first filling machine of the plurality of filling machines for facilitating delivery of containers of the plurality of containers from the first staging area to the first filling machine, a second staging area aligned with a second filling machine of the plurality of filling machines for facilitating delivery of containers of the plurality of containers from the second staging area to the second filling machine, and a receiving area adjacent a supply of the plurality of containers. The feeding assembly is configured to move containers of the plurality of containers from the receiving area to the first staging area and to move containers of the plurality of containers from the receiving area to the second staging area. Each of the first and second staging areas is configured to receive containers of the plurality of containers from the receiving area.

In another aspect, a method is provided for delivering a plurality of containers to a plurality of filling machines for filling the plurality of containers with a substance. The method includes loading a first container of the plurality of containers on a receiving area of a feeding assembly having a first staging area and a second staging area, wherein the feeding assembly is configured to move containers of the plurality of containers from the receiving area to the first and second staging areas, guiding the first container into the first staging area, removing the first container from the first staging area, delivering the first container to a first filling machine of the plurality of filling machines, loading a second container of the plurality of containers on the receiving area of the feeding assembly, guiding the second container into the second staging area, removing the second container from the second staging area, and delivering the second container to a second filling machine of the plurality of filling machines.

In yet another aspect, a transfer assembly is provided for delivering a container to a filling machine configured to fill the container with a substance. The container includes an opening having an open position and a closed position. The transfer assembly includes a body and a gripping mechanism mounted on the body for attaching the body to the container. At least a portion of the body is movable for delivering the container from a source of the container to the filling machine when the container is attached to the body. The transfer assembly also includes a biasing mechanism mounted on the body. The biasing mechanism includes a spring. The biasing mechanism is configured to hold the opening in the open position when the container is attached to the body.

In even another aspect, a method is provided for delivering a container to a filling machine for filling the container with a substance. The method includes loading the container onto a receiving area of a feeding assembly such that the container is orientated generally vertically on the feeding assembly, moving the container from the receiving area to a staging area of the feeding assembly while the container is oriented generally vertically on the feeding assembly, removing the container from the staging area, and delivering the container to the filling machine.

BRIEF DESCRIPTION OF THE DRAWINGS

Corresponding reference characters indicate corresponding parts throughout the several views of the drawings.

DETAILED DESCRIPTION OF THE INVENTION

Figure 1:
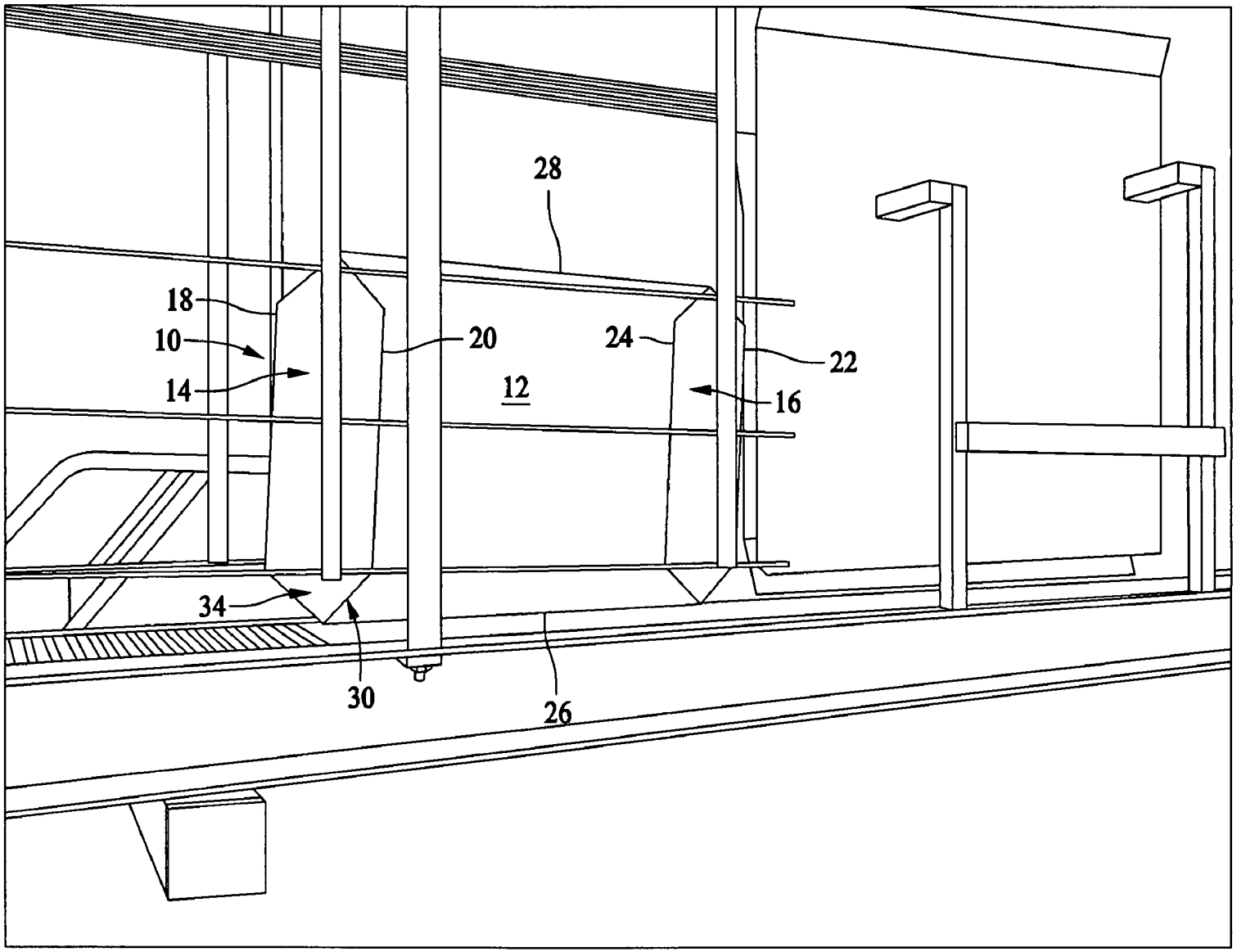
FIG. 1 is a perspective of an exemplary container.

Referring now to the drawings, and more specifically to FIG. 1, an exemplary container is designated in its entirety by the reference numeral 10. Although container 10 may be any container and may contain any substance, in the exemplary embodiments described and/or illustrated herein, and for exemplary purposes only, container 10 is a bag for containing a powder or granular substance, such as, but not limited to, starch, sugar, dry chemicals, cement, or concrete mix. Although container 10 is not limited thereto, in some embodiments container 10 is a multi-wall bag. For exemplary purposes only, the exemplary container 10 illustrated and described herein is a multi-wall "valve" bag, which should be known by one skilled in the art. Container 10 includes a body 12 extending between an end portion (generally designated by 14) and an opposite end portion (generally designated by 16). End portion 14 includes an edge 18 and an opposite edge 20, and end portion 16 includes an edge 22 and an opposite edge 24. As shown in FIG. 1, container 10 is folded generally flat for storage, such that an internal volume (not shown) of container 10 is generally collapsed and such that end portions 14 and 16 are folded generally parallel with body 12 of container 10. When folded generally flat, body 12 of container 10 includes opposite edges 26 and 28 extending between end portions 14 and 16.

Figure 2:
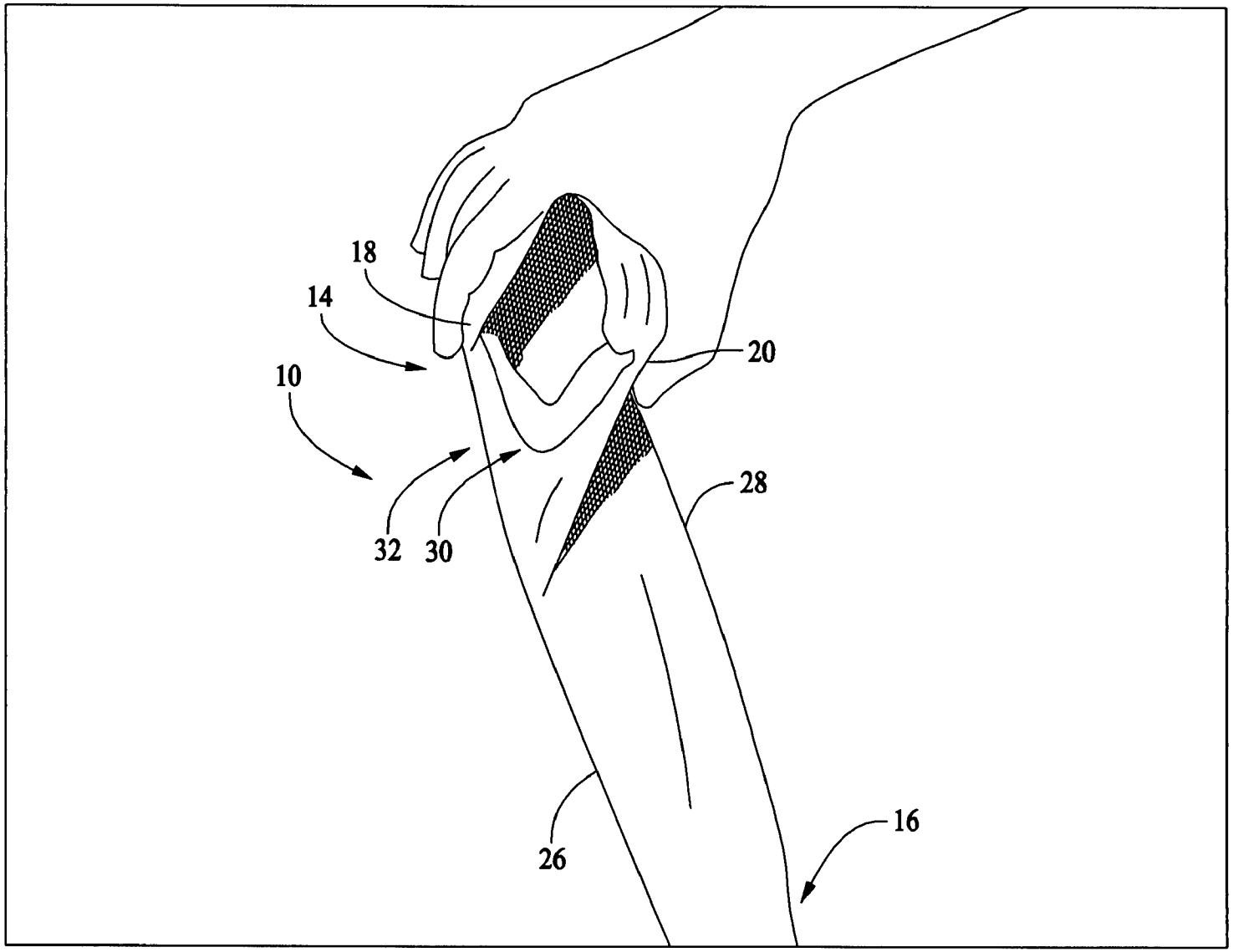
FIG. 2 is a perspective of the container shown in FIG. 1 illustrating an exemplary opening of the container.

As shown in FIG. 2, container 10 includes an opening (generally designated by 30) adjacent end portion 14. In some embodiments (not shown), container 10 includes an opening (not shown) adjacent end portion 16 in addition or alternative to opening 30. Opening 30 includes an open position (generally designated by 32) shown in FIG. 2 and a closed position (generally designated by 34) shown in FIG. 1. Although opening 30 may be opened and/or closed in any way, manner, fashion, method and/or by any means, etc., as shown in FIG. 2 in some embodiments opening 30 may be opened by squeezing edges 18 and 20 of end portion 14 of container 10 at least partially towards each other.

Figure 3:
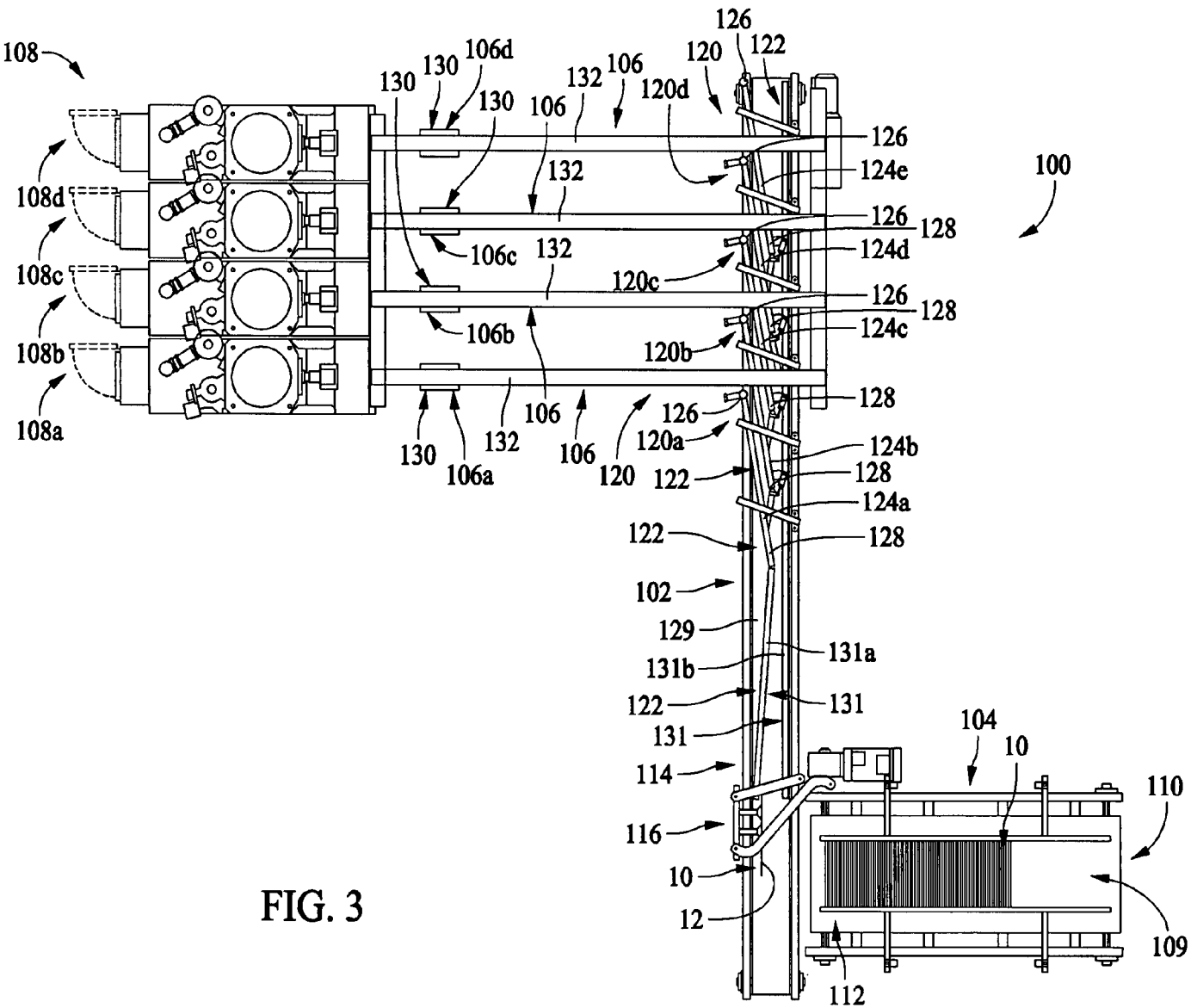
FIG. 3 is a top plan of an exemplary embodiment of an apparatus for filling a plurality of containers with a substance.
Figure 4:
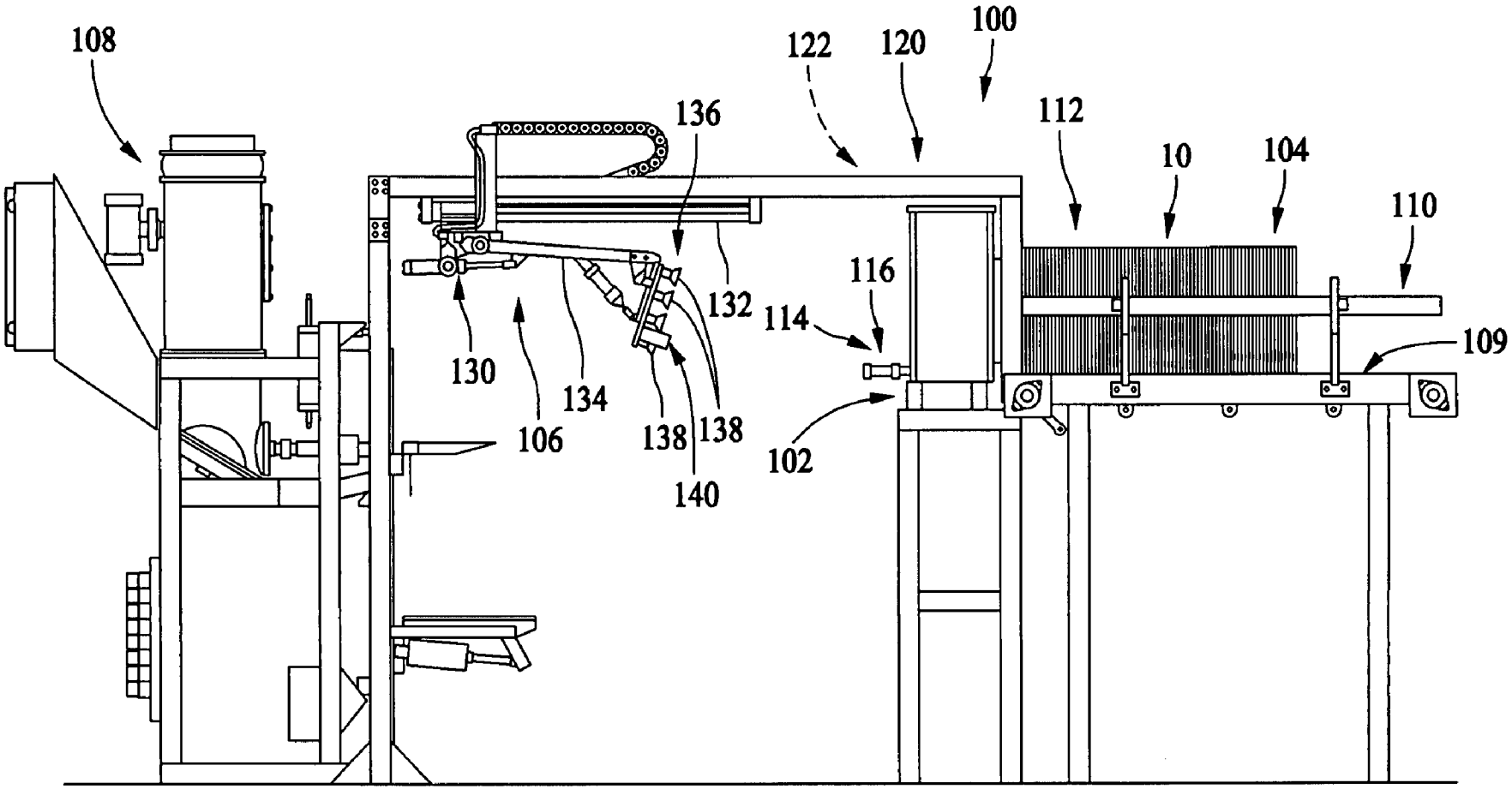
FIG. 4 is a side elevation of the apparatus shown in FIG. 3.

As shown in FIGS. 3 and 4, an apparatus for filling a plurality of containers, such as, but not limited to, container 10 with a substance, such as, but not limited to, starch, sugar, dry chemicals, cement, or concrete mix, is designated in its entirety by the reference numeral 100. The apparatus 100 generally includes a feeding assembly (generally designated by 102) for receiving containers 10 from a supply thereof (e.g., magazine 104 described below) and moving containers 10 to a one or more transfer assemblies (generally designated by 106). Transfer assemblies 106 deliver containers 10 to one or more filling machine(s) (generally designated by 108) that are each operatively connected to a source (not shown) of the substance and are each configured to dispense the substance into a container 10 via the opening 30 (FIG. 2).

Although filling machines 108 may be any filling machine, in one embodiment one or more of filling machines 108 is a valve bag filling machine, commercially available from Smurfit-Stone Container Corporation of Chicago, Ill. The apparatus 100 may include any number of filling machines 108.

Figure 5:
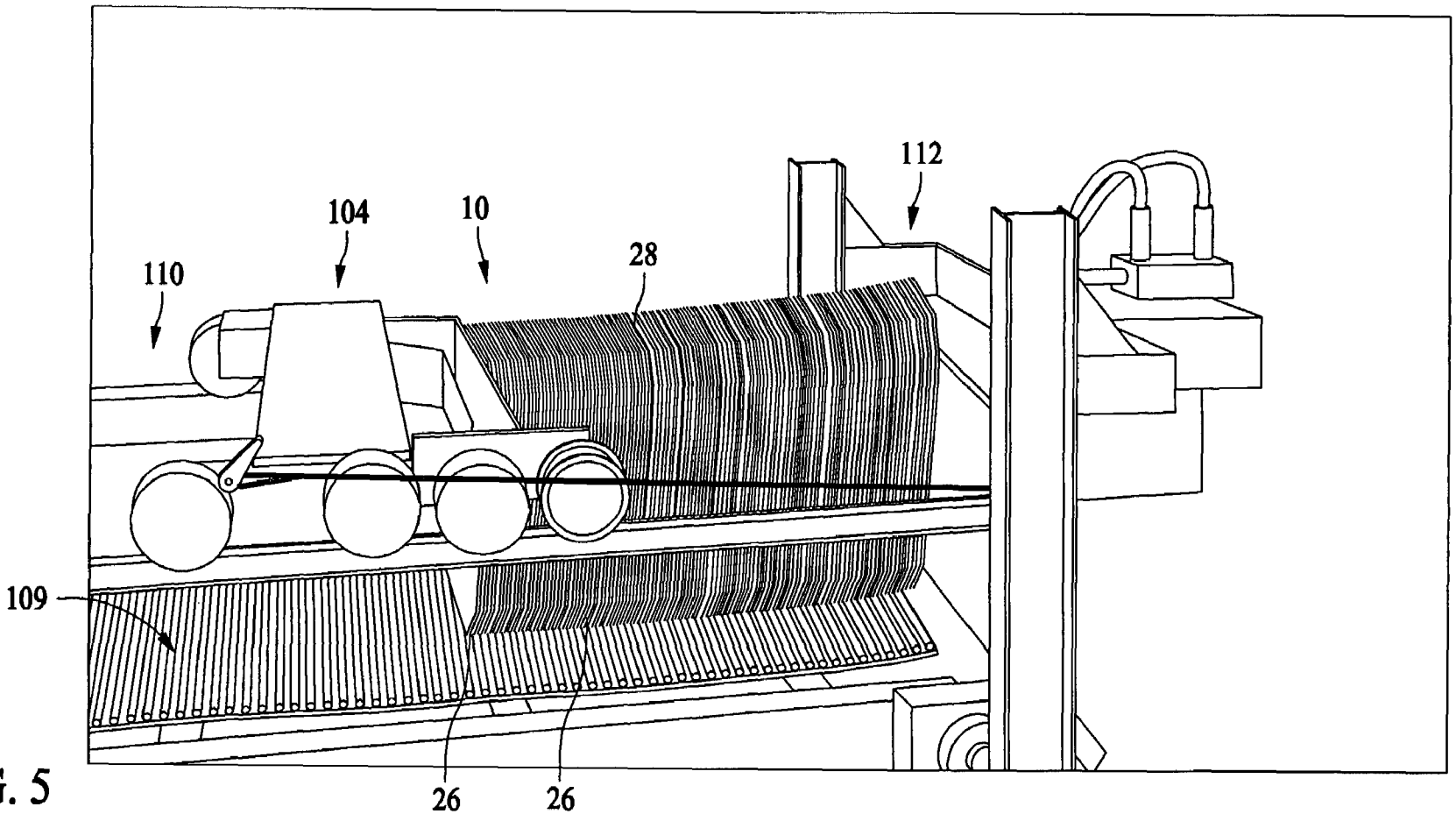
FIG. 5 is a perspective of a portion of the apparatus shown in FIGS. 3 and 4 illustrating an exemplary embodiment of a magazine for containing a supply of containers.

As shown in FIGS. 3-5, although the supply of containers 10 may be of any type, arrangement, and/or configuration, etc. (e.g., stacked on a floor, a pallet, or a conveyor), in some embodiments containers 10 are stacked in a magazine (generally designated by 104). Containers 10 may be stacked (whether or not in magazine 104) in any suitable way, manner, fashion, arrangement, and/or configuration, etc. In some embodiments, a plurality of containers 10 are stacked generally vertically on edge 26 (FIG. 5). In some embodiments, a plurality of containers 10 may be stacked generally vertically on edge 28 (FIG. 5). In some embodiments, a plurality of containers 10 may be stacked generally vertically on edge 18 (FIG. 1). In some embodiments, a plurality of containers 10 may be stacked generally vertically on edge 22 (FIG. 1). As used herein, the phrase "stacked generally vertically on edge 26, 28, 18, or 22" is intended to mean that body 12 of container 10 is angled between about 60° and about 120° with respect to a surface (generally designated by 109) of magazine 104 (or another structure supporting containers 10 such as, but not limited to, a floor, a pallet, and/or a conveyor). In the exemplary embodiment, containers 10 are stacked generally vertically such that body 12 is angled between about 75° and 105° with respect to surface 109. Although magazine 104 may have a capacity for containing any number of containers 10, in some embodiments magazine 104 has a capacity for containing between about 250 and 1500 containers 10 when containers 10 are folded generally flat. Magazine 104 includes an end portion (generally designated by 110) for, for example, loading containers 10 into magazine 104 and an opposite end portion (generally designated by 112) adjacent a receiving area (generally designated by 114) of feeding assembly 102 for, for example, transfer of containers 10 from magazine 104 to feeding assembly 102. The apparatus 100 may include any number of magazines 104.

Figure 6:
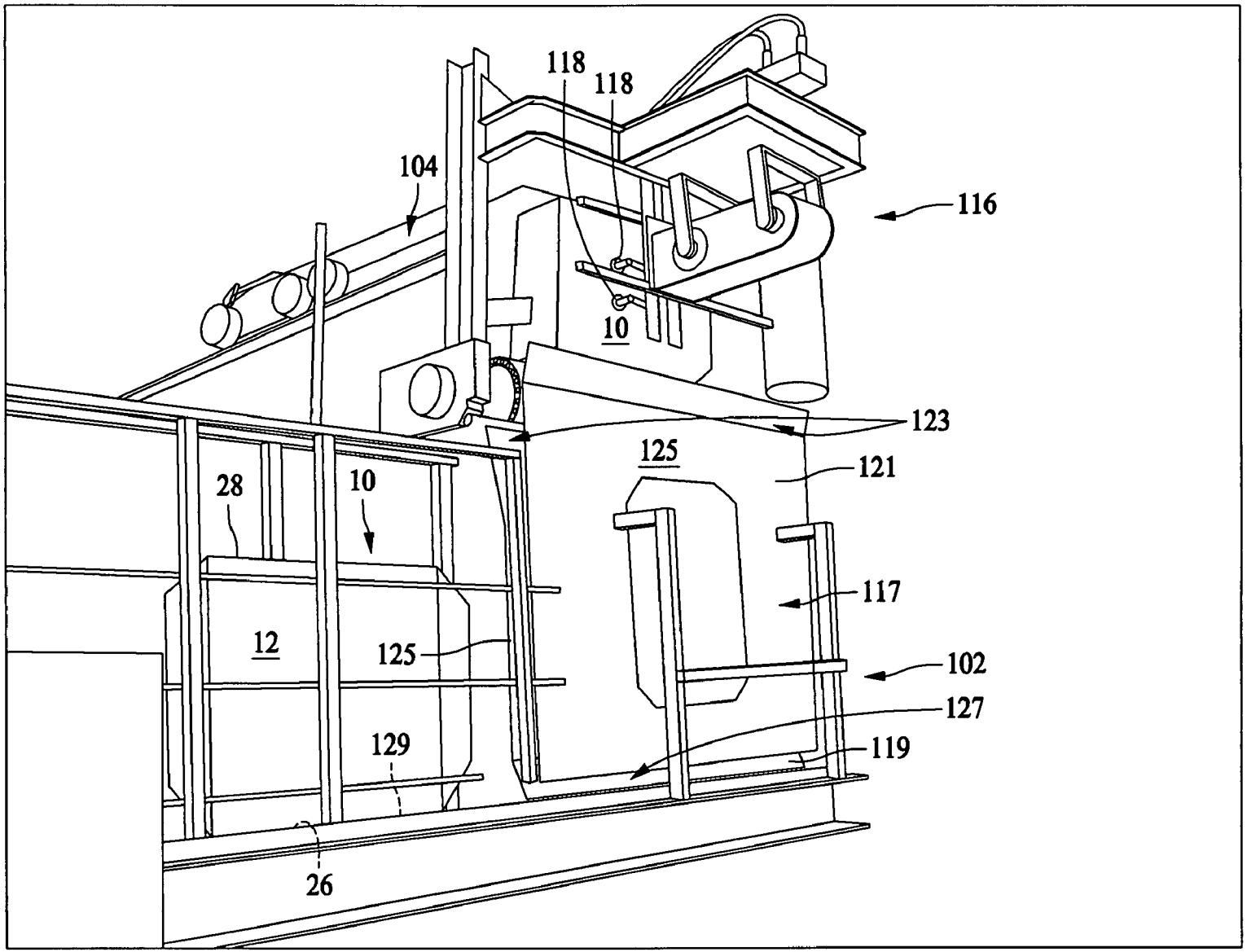
FIG. 6 is a perspective of a portion of the apparatus shown in FIGS. 3 and 4 illustrating an exemplary embodiment of a transfer assembly of the apparatus.

As shown in FIGS. 3, 4, and 6, a transfer assembly (generally designated by 116) removes containers 10 from magazine 104 and places containers 10 on the feeding assembly 102. Transfer assembly 116 may remove containers 10 from magazine 104 and/or place containers 10 on feeding assembly 102 in any suitable way, manner, fashion, method and/or by any means, etc. In the exemplary embodiment, and as can be seen from FIGS. 3 and 6, transfer assembly 116 attaches to a container 10, moves the container 10 over the feeding assembly 102, and places edge 26 (FIG. 6) or edge 28 (FIG. 6) or edge 18 (FIG. 1) or edge 22 (FIG. 1) on feeding assembly 102 such that container 10 is orientated generally vertically on feeding assembly 102 (whether or not containers 10 are orientated similarly within magazine 104). As used herein, the phrase "orientated generally vertically on feeding assembly 102" is intended to mean that body 12 of container 10 is angled between about 60° and about 120° with respect to a surface 129 of feeding assembly 102 supporting container 10. In the exemplary embodiment, containers 10 are orientated generally vertically on feeding assembly 102 such that body 12 is angled between about 75° and 105° with respect to surface 129. In some embodiments, transfer assembly 116 moves container 10 over feeding assembly 102 and drops container 10 onto feeding assembly 102 by detaching therefrom. In some embodiments, transfer assembly 116 detaches from container 10 after placing container 10 on feeding assembly 102. Moreover, in some embodiments transfer assembly 116 cooperates with one or more other transfer assemblies (not shown) to receive containers 10 from the other transfer assembly for placing on feeding assembly 102 or for feeding containers 10 to the other transfer assembly for the other transfer assembly to place on the feeding assembly 102. The magazine 104 may be at any height (e.g., as measured from a floor (not shown)) with respect to feeding assembly 102 (and/or portions thereof) and/or transfer assembly 116. In some embodiments, the magazine 104 is at generally the same height as transfer assembly 116 and/or feeding assembly 102. In some embodiments, magazine 104 is at a different height than transfer assembly 116 and/or feeding assembly 102.

In some embodiments, feeding assembly 102 includes a receiving gate (generally designated by 117) for guiding movement of container 10 as container 10 is moved by transfer assembly 116 and after transfer assembly 116 has detached from container 10 (e.g., movement of container 10 after container 10 has been dropped by transfer assembly 116). Although receiving gate 117 may guide movement of containers 10 in any suitable way, manner, fashion, method and/or by any means, etc., in the exemplary embodiment receiving gate 117 includes two spaced-apart plates 119 and 121 for capturing containers 10 therebetween to guide containers 10 onto feeding assembly 102. In some embodiments, plates 119 and/or 121 include an upper portion (generally designated by 123) that is obliquely angled with respect to a body 125 of plates 119 and/or 121 (and generally angled away from each other in the exemplary embodiment) to facilitate capturing containers 10 between plates 119 and 121. In some embodiments, receiving gate 117 includes a stop (generally designated by 127) thereof for selectively preventing containers 10 from reaching feeding assembly 102 after transfer assembly 116 has detached therefrom. For example, container 10 may be improperly positioned with respect to feeding assembly 102 after transfer assembly 116 has detached from container 10 such that container 10 does not properly travel along feeding assembly 102. For example, if the edge (e.g., edge 26, 28, 18, or 22) of container 10 that will be placed on (by transfer assembly 116) and supported by surface 129 (FIGS. 3 and 6) of feeding assembly 102 is not generally parallel with surface 129 when placed thereon, movement of surface 129 (to, for example, move container 10 along feeding assembly 102 as in an embodiment wherein feeding assembly 102 includes a conveyor including surface 129), for example, may cause container 10 to "cartwheel" along feeding assembly 102. Stop 127 may, for example, prevent container 10 from reaching surface 129 until the edge (e.g., edge 26, 28, 18, or 22) is generally parallel with surface 129. Once the edge (e.g., edge 26, 28, 18, or 22) is generally parallel with surface 129, stop 127 may then release container 10 onto surface 129. Although stop 127 may selectively prevent containers 10 from reaching feeding assembly 102 in any suitable way, manner, fashion, method and/or by any means, etc., in some embodiments stop 127 includes one or more members hingedly connected to receiving gate 117 (for example plates 119 and/or 121). For example, in the exemplary embodiment, stop 127 is hingedly connected to plate 119.

Transfer assembly 116 may attach to containers 10 in any suitable manner, fashion, and/or by any suitable means, etc (e.g., gripping containers 10 with fingers (not shown) or inserting a support (not shown) within containers 10). As shown in FIG. 6, in some embodiments, transfer assembly 116 may include one or more suction mechanism(s) 118 that attach to containers 10 using a pressure differential. Suction mechanism(s) 118 may be passive or may be actively driven, for example, by a vacuum pump (not shown) operatively connected to suction mechanism(s) 118. Movement of the transfer assembly 116 and/or portions thereof to transfer containers 10 from magazine 104 to feeding assembly 102 may be driven by any suitable means. In some embodiments, for example, movement of transfer assembly 116 and/or portions thereof is at least partially driven by a fluid, for example, pneumatically and/or hydraulically. Moreover, in some embodiments, and for example, movement of transfer assembly 116 and/or portions thereof is at least partially driven by electricity.

Although transfer assembly 116 may transfer containers 10 at other rates, in some embodiments transfer assembly 116 transfers containers 10 from magazine 104 to feeding assembly 102 at a rate of between about 15 and 45 containers per minute. In some embodiments, a plurality of transfer assemblies 116 may be used to transfer containers from one or more magazines 104 to feeding assembly 102 to increase the rate of transfer. For example, in some embodiments wherein a plurality of transfer assemblies 116 are used, an overall rate of transfer of containers 10 to feeding assembly 102 may be between about 20 and about 100 containers per minute. The apparatus 100 may include any number of transfer assemblies 116.

Figure 7:
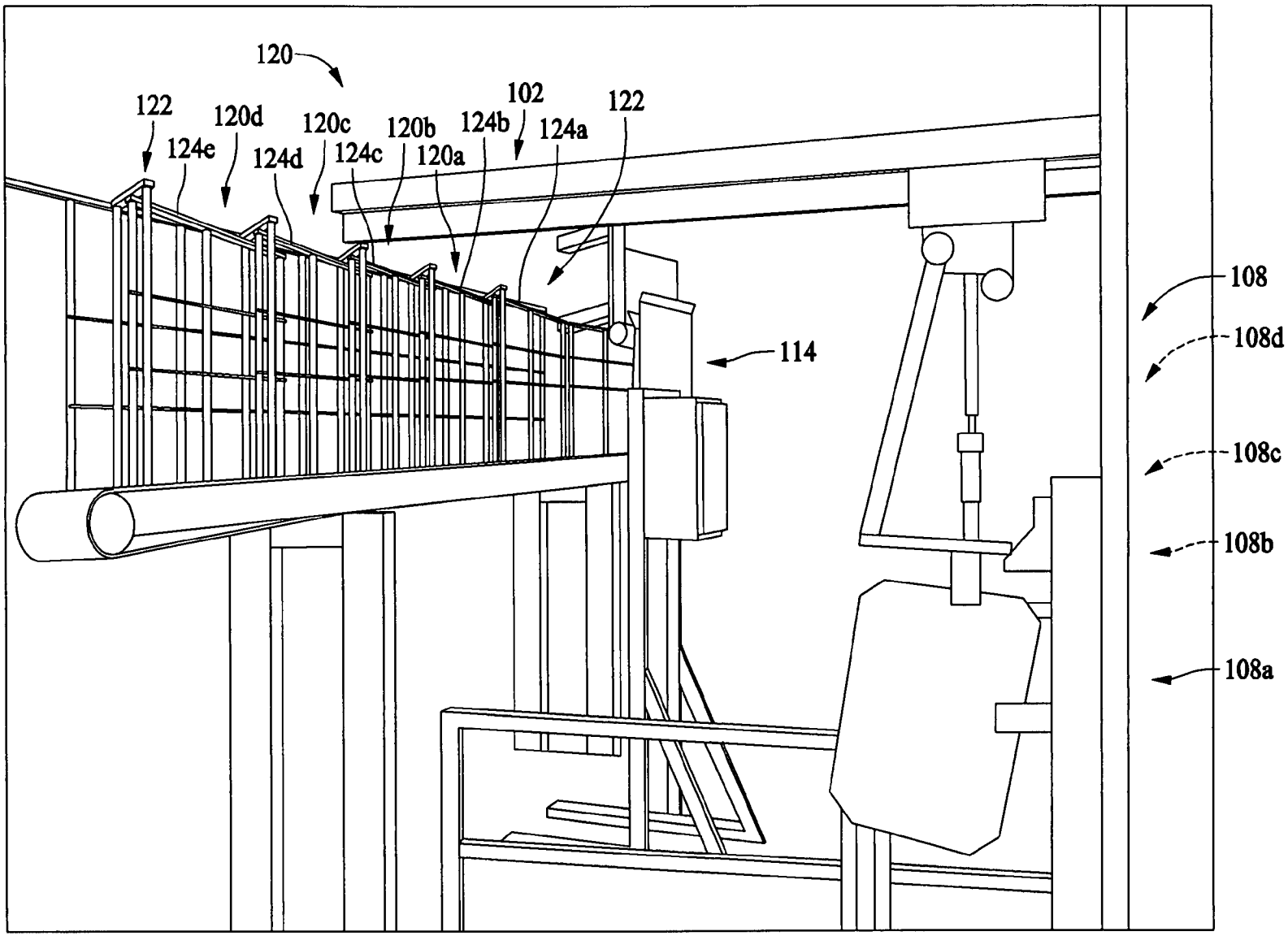
FIG. 7 is a perspective of a portion of the apparatus shown in FIGS. 3 and 4 illustrating an exemplary embodiment of a feeding assembly of the apparatus.

As shown in FIGS. 3 and 7, feeding assembly 102 includes receiving area 114 and one or more staging area(s) (generally designated by 120). Feeding assembly 102 receives containers 10 at receiving area 114 and moves containers 10 to staging areas 120 thereof. Feeding assembly 102 may move the containers in any suitable manner, fashion, and/or by any means, etc. (e.g., using a flow of air to push the containers or pushing the containers using means other than a flow of air). In the exemplary embodiment, feeding assembly 102 is a conveyor. Feeding assembly 102 may be any suitable conveyor, such as, but not limited to, a flat or v-shaped belt driven conveyor. The apparatus 100 may include any number of feeding assemblies 102.

Staging areas 120 are generally aligned with a corresponding filling machine 108 to facilitate delivery of containers 10 to filling machines 108. For example, when apparatus 100 includes more than one filling machine 108, feeding assembly 102 may include more than one staging area 120. In the exemplary embodiment, apparatus 100 includes an equal number of staging areas 120 and filling machines 108. In some embodiments, apparatus 100 includes a different number of staging areas 120 than filling machines 108. The apparatus 100 may include any number of staging areas 120. Each staging area 120 is generally aligned with one or more filling machine(s) 108 to facilitate delivery of containers 10 received from receiving area 114 to the filling machine 108 that the particular staging area 120 is aligned with. For example, in the exemplary embodiment, apparatus 100 includes four staging areas 120*a*, 120*b*, 120*c*, and 120*d* that are each aligned with one filling machine 108*a*, 108*b*, 108*c*, and 108*d*, respectively. Any of staging areas 120*a*, 120*b*, 120*c*, and 120*d* may be referred to herein as a first and/or a second staging area. Any of filling machines 108*a*, 108*b*, 108*c*, and 108*d* may be referred to herein as a first and/or a second filling machine. Although staging areas 120 are shown in FIGS. 3 and 7 as each being aligned with only one filling machine 108 and each generally facing filling machine 108, staging areas 120 may each be aligned with one or more filling machines 108 and may be aligned with a filling machine(s) 108 in any suitable orientation and at any suitable distance that facilitates delivering containers 10 from staging area 120 to filling machine(s) 108 that the particular staging area 120 is aligned with.

Using the exemplary embodiment as an example, to feed a plurality of filling machines 108 from magazine 104, feeding assembly 102 will move some of the containers 10 contained within magazine 104 from receiving area 114 to staging area 120*a* for delivery to filling machine 108*a*. Similarly, feeding assembly 102 will move some of containers 10 contained within magazine 104 from receiving area 114 to staging area 120*b* for delivery to filling machine 108*b*, feeding assembly 102 will move some of containers 10 contained within magazine 104 from receiving area 114 to staging area 120*c* for delivery to filling machine 108*c*, and feeding assembly 102 will move some of containers 10 contained within magazine 104 from receiving area 114 to staging area 120*d* for delivery to filling machine 108*d*. To facilitate moving containers 10 to different staging areas 120*a*, 120*b*, 120*c*, and 120*d*, apparatus 100 may include a guide (generally designated by 122) configured to guide containers 10 to each of staging areas 120*a*, 120*b*, 120*c*, and 120*d*. Guide 122 may be configured to guide containers 10 to each of staging areas 120*a*, 120*b*, 120*c*, and 120*d* in any suitable fashion, manner, arrangement, and/or by any means, etc. In some embodiments, guide 122 is operatively connected to feeding assembly 102 between receiving area 112 and each of staging areas 120*a*, 120*b*, 120*c*, and 120*d* for guiding containers 10 to various staging areas 120*a*, 120*b*, 120*c*, and 120*d* as feeding assembly 102 moves containers 10.

As an example of one suitable fashion, manner, arrangement, and/or means, etc., of guide 122, in the exemplary embodiment guide 122 includes one or more movable members 124 and one or more non-movable members (generally designated by 131). In the exemplary embodiment, guide 122 includes two non-movable members 131*a* and 131*b*. Movable members 124 are each movable to selectively guide containers 10 into a corresponding staging area 120. As shown in FIG. 3, in the exemplary embodiment guide 122 includes five movable members 124*a*, 124*b*, 124*c*, 124*d*, and 124*e*. Each of movable members 124 may be used alone or in combination with other movable members 124 to guide containers 10 into each of the staging areas 120. For example, movable members 124 may each be rotated about an axis of rotation 126 to thereby rotate an end portion 128 of each of movable members 124 outwardly to direct a container into a staging area 120 and/or restrict a container 10 from traveling to staging areas 120 further downstream along feeding assembly 102. For example, movable members 124*a* and/or 124*b* are movable to direct a container 10 into staging area 120*a*, and more specifically between movable members 124*a* and 124*b*, as the container 10 moves along feed assembly 102 (e.g., after passing non-movable member 131). Similarly, movable members 124*b* and/or 124*c* are movable to direct a container 10 into staging area 120*b*, and more specifically between movable members 124*b* and 124*c*, as container 10 moves along feed assembly 102, movable members 124*c* and/or 124*d* are movable to direct a container 10 into staging area 120*c*, and more specifically between movable members 124*c* and 124*d*, as the container 10 moves along feed assembly 102, and movable members 124*d* and/or 124*e* are movable to direct a container 10 into staging area 120*d*, and more specifically between movable members 124*d* and 124*e*, as container 10 moves along feed assembly 102. In some embodiments, non-movable member 131*a* is movable for guiding containers 10 and/or one or more of the specific movable members 124 illustrated herein are non-movable for guiding containers 10. Movement of movable members 124 may be driven by any suitable means. In some embodiments, for example, movement of one or more of movable members 124 is at least partially driven by a fluid, such as, but not limited to, pneumatically and/or hydraulically. Moreover, in some embodiments, and for example, movement of one or more movable members 124 is at least partially driven by electricity.

Referring to FIGS. 3 and 4, in the exemplary embodiment transfer assemblies 106 remove containers 10 from staging areas 120 and deliver containers 10 to filling machines 108 when filling machines 108 are ready to fill a container 10. The apparatus 100 may include any number of transfer assemblies 106. When apparatus 100 includes more than one filling machine 108 and/or staging area 120, apparatus 100 may include more than one transfer assembly 106. In the exemplary embodiment, apparatus 100 includes an equal number of transfer assemblies 106, staging areas 120, and filling machines 108. In some embodiments, apparatus 100 includes a different number of transfer assemblies 106 than staging areas 120 and/or filling machines 108. Each transfer assembly 106 removes containers 10 from one or more staging area(s) 120 and delivers the containers 10 to one or more filling machine(s) 108. For example, as shown in FIG. 3, in the exemplary embodiment apparatus 100 includes four transfer assemblies 106*a*, 106*b*, 106*c*, and 106*d* that each remove containers 10 from one staging area 120*a*, 120*b*, 120*c*, and 120*d*, respectively, and deliver the containers 10 to one filling machine 108*a*, 108*b*, 108*c*, and 108*d*, respectively, when the respective filling machine 108 is ready to fill a container 10. Any of transfer assemblies 106*a*, 106*b*, 106*c*, and 106*d* may be referred to herein as a first and/or a second transfer assembly.

Transfer assemblies 106 and/or any portion thereof may move between feeding assembly 102 and filling machines 108 in any suitable manner, fashion, and/or by any means, etc. However, in the exemplary embodiment, a body (generally designated by 130) of each of transfer assemblies 106 is mounted on a rail 132 extending between filling machines 108 and staging areas 120 for movement along rail 132 (and with respect to feeding assembly 102 and filling machines 108). In some embodiments, for example, movement of body 130 and/or portions thereof along rail 132 is at least partially driven by a fluid, for example, pneumatically and/or hydraulically. Moreover, in some embodiments, and for example, movement of body 130 and/or portions thereof along rail 132 is at least partially driven by electricity. As shown herein, rail 132 is shown as mounted on feeding assembly 102 and filling machines 108. However, rail 132 may be mounted anywhere, such as, but not limited to, a floor and/or a ceiling.

Figure 8:
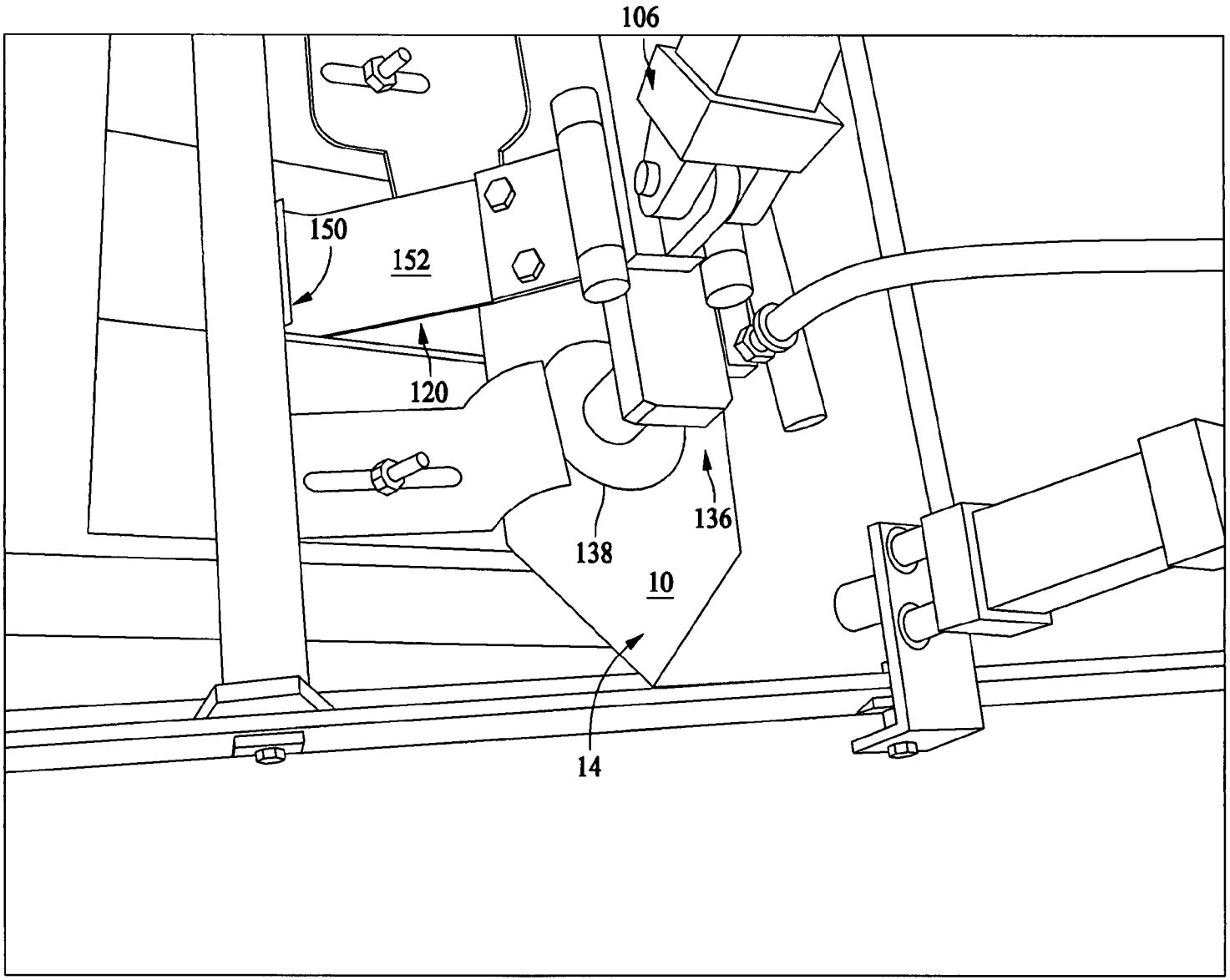
FIG. 8 is a perspective of a portion of the apparatus shown in FIGS. 3 and 4 illustrating an exemplary embodiment of a transfer assembly of the apparatus attached to an exemplary container.

Transfer assemblies 106 may each remove containers 10 from staging areas 120 and/or deliver containers 10 to filling machines 108 in any suitable way, manner, fashion, method and/or by any means, etc. As shown in FIG. 4, in the exemplary embodiment, transfer assemblies 106 each include an arm 134 mounted on body 130 for movement with respect to body 130. When a filling machine 108 (e.g., filling machine 108*a* shown in FIG. 3) is ready to fill a container 10, body 130 of the corresponding transfer assembly 106 (e.g., transfer assembly 106*a* shown in FIG. 3) may be moved along rail 132 (if not already in position) such that arm 134 is in reach of the corresponding staging area 120 (e.g., staging area 120*a* shown in FIG. 3). Arm 134 may then be moved with respect to body 130 to position a gripping mechanism (generally designated by 136) mounted on arm 134 in position with respect to the corresponding staging area 120 for attachment to container 10 (to thereby attach container 10 to body 130 of transfer assembly 106). Gripping mechanism 136 may be any suitable gripping mechanism that attaches to containers 10 in any suitable manner, fashion, and/or by any suitable means, etc (e.g., gripping containers 10 with fingers (not shown) or inserting a support (not shown) within containers 10). In the exemplary embodiment, gripping mechanism 136 includes one or more suction mechanism(s) 138 that attach to containers 10 using a pressure differential, as shown in FIG. 8. Referring to FIG. 4, gripping mechanism 136 (and/or suction mechanism(s) 138) may be passive or may be actively driven, for example, by a vacuum pump (not shown) operatively connected to gripping mechanism 136 (and/or suction mechanism(s) 138). Movement of arm 134 and/or portions thereof to remove containers 10 from staging areas 120 and/or deliver containers 10 to filling machines 108 may be driven by any suitable means. In some embodiments, for example, movement of arm 134 and/or portions thereof is at least partially driven by a fluid, for example, pneumatically and/or hydraulically. Moreover, in some embodiments, and for example, movement of arm 134 and/or portions thereof is at least partially driven by electricity.

Figure 9:
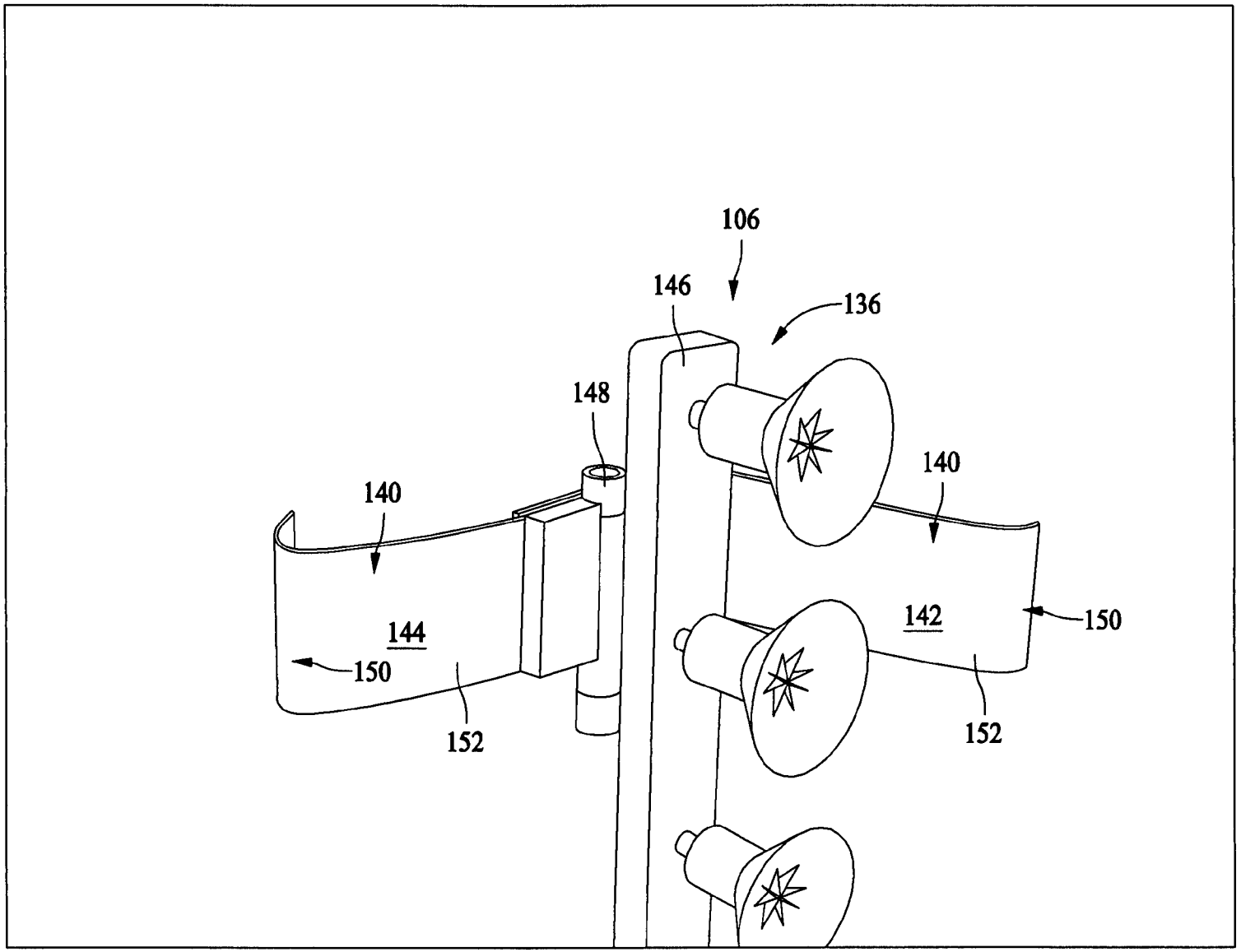
FIG. 9 is a perspective of a portion of the apparatus shown in FIGS. 3 and 4 illustrating an exemplary embodiment of a biasing mechanism of the apparatus.
Figure 10:
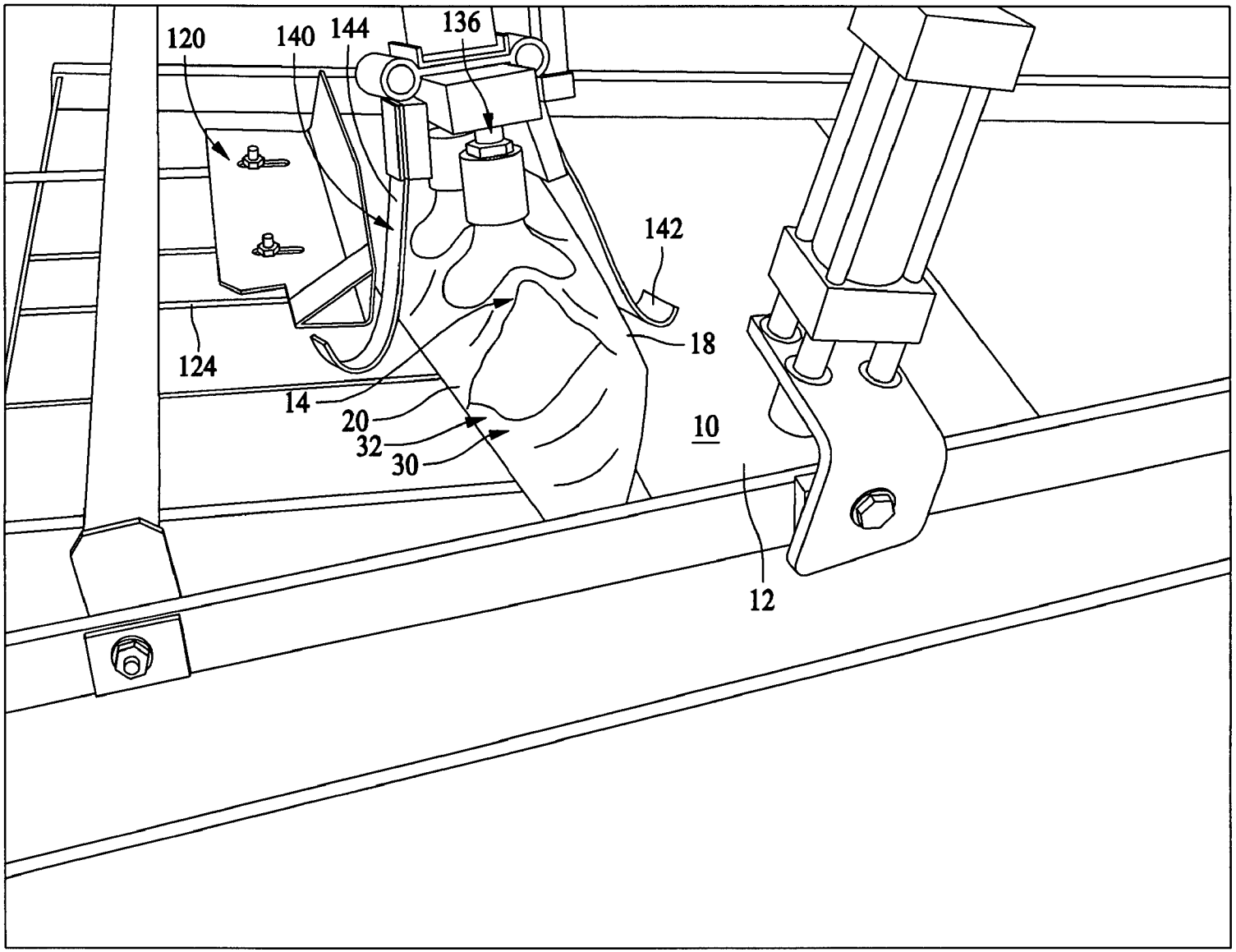
FIG. 10 is a perspective of a portion of the apparatus shown in FIGS. 3 and 4 illustrating the biasing mechanism shown in FIG. 9 opening an exemplary container.

As shown in FIGS. 4 and 9, each of transfer assemblies 106 includes a biasing mechanism (generally designated by 140) configured to hold opening 30 (FIGS. 1 and 2) in open position 32 (FIG. 2) during delivery of a container 10 (FIG. 4) to a filling machine 108. Biasing mechanism 140 may hold opening 30 in open position 32 in any suitable way, manner, fashion, method and/or by any means, etc. As shown in FIG. 10, in the exemplary embodiment, biasing mechanism 140 is configured to open (and maintain) the opening 30 by squeezing opposite edges 18 and 20 of end portion 14 of a container 10 towards each other. Biasing mechanism 140 may be any type of biasing mechanism that biases using any means. For example, in some embodiments biasing mechanism 140 may include a spring, such as, but not limited to, a helical or other shaped spring. In some embodiments, biasing mechanism 140 consists entirely of a spring. As used herein, the term "spring" is intended to mean any elastic body or device that recovers its original shape when released after being distorted. In some embodiments, biasing mechanism 140 biases at least partially using a fluid, such as, but not limited to, a pneumatic or hydraulic fluid. Moreover, in some embodiments, biasing mechanism 140 biases at least partially using electricity. A biasing force of biasing mechanism 140 may be pre-selected depending on the type of container being filled and the type, configuration, and/or arrangement of biasing mechanism 140. For example, in the exemplary embodiment wherein biasing mechanism 140 is configured to squeeze opposite edges 18 and 20 of end portion 14 of a container 10 towards each other, the biasing force of biasing mechanism 140 may be selected as sufficient to squeeze edges 18 and 20 towards each other enough to open opening 30 but insufficient to collapse end portion 14 of the container 10.

As shown in FIG. 9, in the exemplary embodiment biasing mechanism 140 includes two or more members 142 and 144 that are biased at least partially towards each other. Although members 142 and 144 may be mounted anywhere on transfer assembly 106, in the exemplary embodiment members 142 and 144 are mounted on a body 146 of gripping mechanism 136. As discussed above with respect to biasing mechanism 140 generally, members 142 and 144 may be biased toward each other in any suitable way, manner, fashion, method and/or by any means, etc. In the exemplary embodiment, members 142 and 144 are each mounted on body 146 of gripping mechanism 136 using a hinge 148 for rotary movement about hinge 148. Hinges 148 each include a helical spring (not shown) that biases members 142 and 144 toward each other. Of course, hinges 148 may include any other type of biasing mechanisms than helical springs, or springs generally. FIG. 9 illustrates member 144 rotated away from member 142 against the bias of hinge 148 and member 142 rotated towards member 144 with the bias. In some embodiments, in addition or alternative to hinges 148, members 142 and/or 144 themselves may be springs (or may each form a portion of one or more springs) mounted on body 146 in such a way as to be biased toward each other. As shown in FIG. 10, members 142 and 144 squeeze opposite edges 18 and 20 of end portion 14 of a container 10 towards each other to open the opening 30. As described above, in some embodiments, the biasing force of biasing mechanism 140 may be selected as sufficient to squeeze edges 18 and 20 towards each other enough to open opening 30 but insufficient to collapse end portion 14 of the container 10. In some embodiments, as shown in FIG. 9, the members 142 and 144 may abut against a portion of body 146 of gripping mechanism 136 to prevent members 142 and 144 from collapsing end portion 14 of container 10.

Referring now to FIG. 8, once gripping mechanism 136 is positioned with respect to a container 10 within a staging area 120, body 130 (FIGS. 3 and 4) and/or arm 134 (FIG. 4) can be moved to move gripping mechanism 136 towards container 10 and gripping mechanism 136 (and more specifically suction mechanism(s) 138 in the exemplary embodiment) can attach to end portion 14 of container 10, to thereby attach body 130 of transfer assembly 106 to container 10. As gripping mechanism 136 is moved towards container 10, end portions (generally designated by 150) of each of members 142 and 144 of biasing mechanism 140 contact a portion of movable member 124 behind container 10 and are thereby forced, against the bias, to rotate away from each other, as shown in FIG. 8, such that members 142 and 144 are spread across end portion 14 of container 10. As shown in FIGS. 8 and 9, in some embodiments end portion 150 of members 142 and/or 144 is obliquely angled with respect to another portion of a body 152 of members 142 and/or 144 to facilitate rotation of members 142 and 144 away from each other, against the bias, when end portions 150 contact movable member 124. Referring now to FIG. 10, once gripping mechanism 136 is attached to container 10, body 130 (FIGS. 3 and 4) can be moved along rail 132 (FIGS. 3 and 4) away from staging area 120 and toward the corresponding filling machine 108 (and/or arm 134 can be moved away from staging area 120) to remove container 10 from staging area 120. In some embodiments, gripping mechanism 136 is rotated (e.g., by arm 134) such that end portion 14 of container 10 unfolds with respect to body 12 of container 10 and members 142 and 144 of biasing mechanism 140 move out of contact with movable member 124. Accordingly, members 142 and 144 of biasing mechanism 136 rotate towards each other under the force of the bias and thereby squeeze opposite edges 18 and 20 of end portion 14 of container 10 to open (and maintain) opening 30 in open position 32. Body 130 and/or arm 134 can then be moved away from staging area 120 to remove container 10 from staging area 120. In some embodiments, movement of body 130 and/or arm 134 (e.g., in addition or alternative to rotation of gripping mechanism 136) away from staging area 120 unfolds end portion 14 of container 10 with respect to body 12 of container 10 and causes members 142 and 144 of biasing mechanism 140 to open opening 30 in open position 32.

Figure 11:
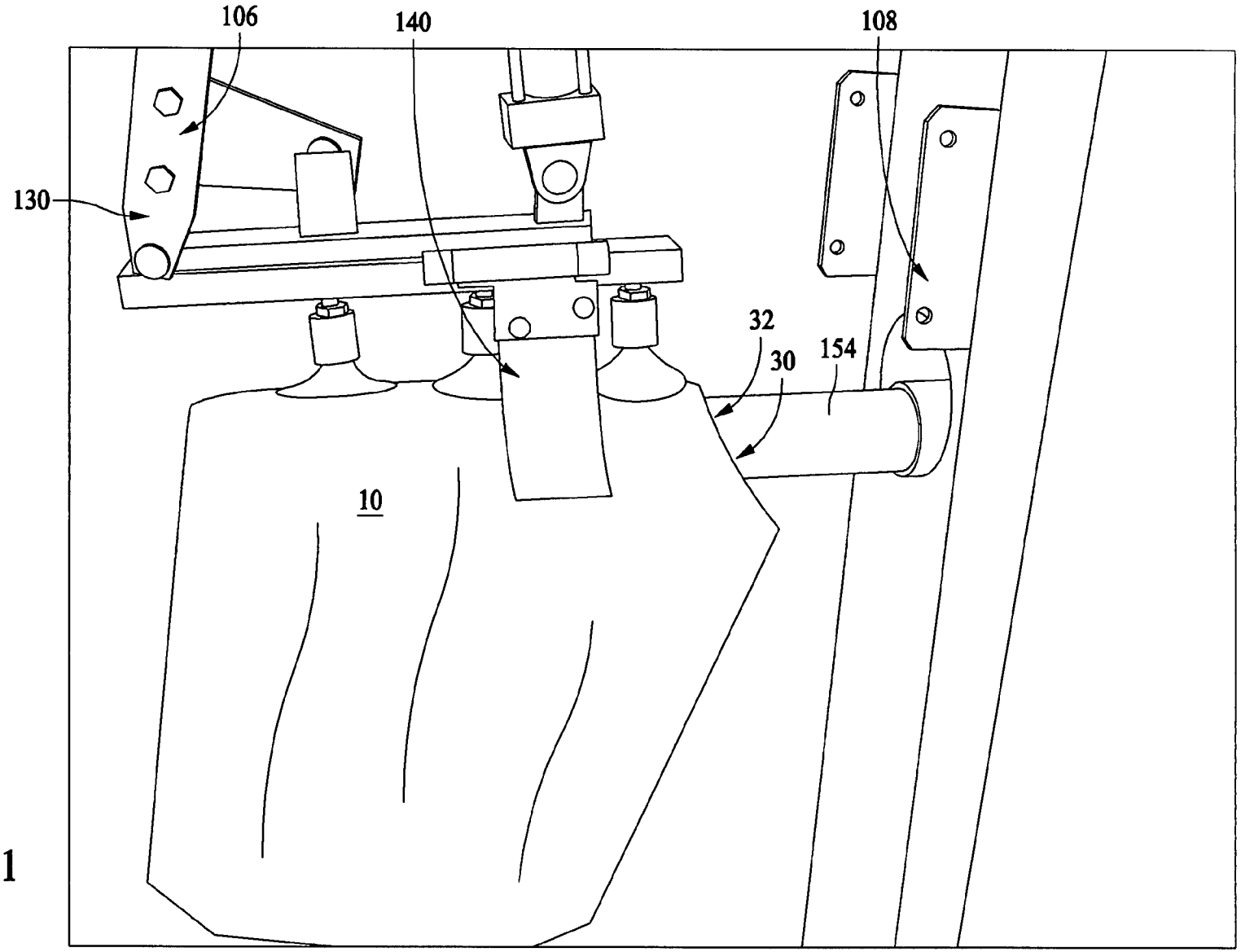
FIG. 11 is a perspective of a portion of the apparatus shown in FIGS. 3 and 4 illustrating an exemplary container being filled by an exemplary embodiment of a filling machine of the apparatus.

Referring now to FIG. 11, body 130 (FIGS. 3 and 4) of transfer assembly 106 is then moved along rail 132 (FIGS. 3 and 4) away from staging area 120 (FIGS. 3, 4, 7, 8, and 10) and toward the corresponding filling machine 108 (and/or arm 134, shown in FIG. 4, can be moved away from staging area 120 and toward the corresponding filling machine 108) to deliver container 10 to the corresponding filling machine 108. As discussed above, biasing mechanism 140 holds opening 30 of container 10 in open position 32 as container 10 is delivered to filling machine 108. Transfer assemblies 106 may each deliver containers 10 to filling machines 108 in any suitable way, manner, fashion, method and/or by any means, etc. However, in the exemplary embodiment, body 130 of transfer assembly 106 is moved along rail 132 until the corresponding filling machine 108 is within reach of arm 134. Arm 134 is then moved to position container 10 with respect to filling machine 108 so a dispenser 154 on filling machine 108 communicates with opening 30 of container 10 to fill container 10. In some embodiments, transfer assembly 106 does not remain attached to container 10 during filling thereof, but rather container 10 is supported by dispenser 154 or other means. In some embodiments, after filling of container 10, container 10 is moved from filling machine 108 (e.g., moved by an assembly (not shown) and/or dropped) to an assembly (not shown, e.g., a conveyor) that moves container 10 to another location. In some embodiments, transfer assembly 106 remains attached to the container 10 during filling thereof to, for example, support container 10. In some embodiments, transfer assembly 106 may remove container 10 from filling machine 108 when container 10 is full and move container 10 to another location.

Movement of arm 134 and/or portions thereof may be driven by any suitable means. In some embodiments, for example, movement of arm 134 and/or portions thereof is at least partially driven by a fluid, for example, pneumatically and/or hydraulically. Moreover, in some embodiments, and for example, movement of arm 134 and/or portions thereof is at least partially driven by electricity.

In some embodiments, a container 10 may be rejected from a filling machine 108, for example, because container 10 is damaged, because container 10 is not orientated properly with respect to filling machine 108 such that dispenser 154 does not communicate with opening 30, because opening 30 did not completely or partially open, and/or because filling machine 108 failed to begin filling container 10. In some embodiments, if a container 10 is rejected from a filling machine 108, transfer assembly 106 may move container 10 away from filling machine 108 and release container 10. For example, transfer assembly 106 may release container 10 (e.g., drop container 10 onto a floor (not shown)) at a location that does not interfere with operation of apparatus 100.

Although the apparatus, assemblies, and methods described and/or illustrated herein are described and illustrated herein with respect to a bag, and more specifically with respect to a bag for containing concrete mix, the apparatus, assemblies, and methods described and/or illustrated herein are not limited to bags nor concrete mix. Rather, the apparatus, assemblies, and methods described and/or illustrated herein are applicable to any container.

Exemplary embodiments of apparatus, assemblies, and methods are described above in detail. The apparatus, assemblies, and methods are not limited to the specific embodiments described herein, but rather, components of each apparatus and assembly, and steps of each method, may be utilized independently and separately from other components and steps described herein. Each apparatus and assembly component, and method step, can also be used in combination with other components and/or method steps.

When introducing elements of the apparatus, assemblies, and/or methods described and/or illustrated herein and/or embodiment(s) thereof, the articles "a", "an", "the" and "said" are intended to mean that there are one or more of the elements. The terms "comprising", "including" and "having" are intended to be inclusive and mean that there may be additional elements other than the listed elements.

While the apparatus, assemblies, and methods described and/or illustrated herein have been described in terms of various specific embodiments, those skilled in the art will recognize that the apparatus, assemblies, and method described and/or illustrated herein can be practiced with modification within the spirit and scope of the claims.

What is claimed is:

1. Apparatus for delivering a plurality of containers to a plurality of filling machines for filling of the containers with a substance, said apparatus comprising:

a feeding assembly comprising a first staging area aligned with a first filling machine of the plurality of filling machines for facilitating delivery of containers of the plurality of containers from said first staging area to the first filling machine, a second staging area aligned with a second filling machine of the plurality of filling machines for facilitating delivery of containers of the plurality of containers from said second staging area to the second filling machine, and a receiving area adjacent a supply of the plurality of containers, wherein said feeding assembly is configured to move containers of the plurality of containers from said receiving area to said first staging area and to move containers of the plurality of containers from said receiving area to said second staging area, and wherein each of said first and second staging areas are configured to receive containers of the plurality of containers from said receiving area; and a transfer assembly configured to remove a container of the plurality of containers from at least one of said first and second staging areas of said feeding assembly and deliver the container to at least one of said first and second filling machines, said transfer assembly comprising a body and an arm, said arm being movable with respect to said body and said body being movable with respect to said feeding assembly and said first and second filling machines for removing a container of the plurality of containers from at least one of said first and second staging areas and delivering the container to at least one of said first and second filling machines.

2. Apparatus in accordance with claim 1 further comprising a guide configured to guide containers of the plurality of containers to said first staging area and to guide containers of the plurality of containers to said second staging area.

3. Apparatus in accordance with claim 2 wherein said guide is operatively connected to said feeding assembly between said receiving area and said first staging area and between said receiving area and said second staging area for guiding containers of the plurality of containers as said feeding assembly moves the containers.

4. Apparatus in accordance with claim 2 wherein said guide comprises a plurality of movable members for guiding containers of the plurality of containers into said first and second staging areas as the containers move along said feeding assembly.

5. Apparatus in accordance with claim 1 further comprising a magazine for containing the supply of the plurality of containers.

6. Apparatus in accordance with claim 5, wherein a container placement assembly is configured to remove a container of the plurality of containers from said magazine and place the container on said feeding assembly.

7. Apparatus in accordance with claim 1 wherein said feeding assembly comprises a conveyor.

8. Apparatus in accordance with claim 1 wherein said feeding assembly is configured to support containers of the plurality of containers such that the containers are orientated generally vertically on said feeding assembly, and wherein said feeding assembly is configured to move containers of the plurality of containers from said receiving area to said first staging area and to move containers of the plurality of containers from said receiving area to said second staging area while the containers are orientated generally vertically on said feeding assembly.

9. Apparatus in accordance with claim 1 wherein said transfer assembly comprises a first transfer assembly configured to remove a container of the plurality of containers from said first staging area and deliver the container to said first filling machine and a second transfer assembly configured to remove a container of the plurality of containers from said second staging area and deliver the container to said second filling machine.

10. Apparatus in accordance with claim 1 wherein said transfer assembly comprises at least one suction mechanism configured to attach to a container of the plurality of containers using a pressure differential.

11. Apparatus in accordance with claim 1 wherein the plurality of containers each include an opening having an open position and a closed position, said transfer assembly comprising a biasing mechanism configured to hold the opening in the open position during delivery of a container of the plurality of containers to at least one of said first and second filling machines.

12. Apparatus in accordance with claim 11 wherein said biasing mechanism comprises a spring.

13. Apparatus in accordance with claim 11 wherein said biasing mechanism is configured to squeeze opposite edges of an end portion of a container of the plurality of containers towards each other to hold the opening in the open position.

14. Apparatus in accordance with claim 11 wherein said biasing mechanism comprises two members biased at least partially toward each other.

15. A method for delivering a plurality of containers to a plurality of filling machines for filling the plurality of containers with a substance, said method comprising:

loading a first container of the plurality of containers onto a receiving area of a feeding assembly having a first staging area and a second staging area, wherein the feeding assembly is configured to move containers of the plurality of containers from the receiving area to the first and second staging areas;

guiding the first container into the first staging area;

removing the first container from the first staging area using a first transfer assembly;

delivering the first container to a first filling machine of the plurality of filling machines using the first transfer assembly;

loading a second container of the plurality of containers onto the receiving area of the feeding assembly;

guiding the second container into the second staging area;

removing the second container from the second staging area using a second transfer assembly; and delivering the second container to a second filling machine of the plurality of filling machines using the second transfer assembly, wherein said first transfer assembly comprises a first body and a first arm, said first arm being movable with respect to said first body and said first body being movable with respect to said feeding assembly and said first filling machine for removing the first container from the first staging area and delivering the first container to the first filling machine, and wherein said second transfer assembly comprises a second body and a second arm, said second arm being movable with respect to said second body and said second body being movable with respect to said feeding assembly and said second filling machine for removing the second container from the second staging area and delivering the second container to the second filling machine.

16. A method in accordance with claim 15 wherein said guiding the first container into the first staging area comprises moving a first member operatively connected to the first staging area, and said guiding the second container into the second staging area comprises moving a second member operatively connected to the second staging area.

17. A method in accordance with claim 15 wherein said loading a first container of the plurality of containers comprises removing the first container from a magazine containing the plurality of containers, and said loading a second container of the plurality of containers comprises removing the second container from the magazine.

18. A method in accordance with claim 15 wherein the plurality of containers each include an opening having an open position and a closed position, and said delivering the first container to a first filling machine comprises holding the opening in the open position using a biasing mechanism.

19. A method in accordance with claim 15 wherein the plurality of containers each include an opening having an open position and a closed position, and said delivering the second container to a second filling machine comprises holding the opening in the open position using a biasing mechanism.

20. An apparatus for delivering a plurality of containers to a plurality of filling machines for filling of the containers with a substance, said apparatus comprising:

a feeding assembly comprising a first staging area aligned with a first filling machine of the plurality of filling machines for facilitating delivery of containers of the plurality of containers from said first staging area to the first filling machine, a second staging area aligned with a second filling machine of the plurality of filling machines for facilitating delivery of containers of the plurality of containers from said second staging area to the second filling machine, and a receiving area adjacent a supply of the plurality of containers, wherein said feeding assembly is configured to move containers of the plurality of containers from said receiving area to said first staging area and to move containers of the plurality of containers from said receiving area to said second staging area, and wherein each of said first and second staging areas are configured to receive containers of the plurality of containers from said receiving area; and a transfer assembly configured to remove a container of the plurality of containers from at least one of said first and second staging areas of said feeding assembly and deliver the container to at least one of said first and second filling machines, said transfer assembly comprising at least one suction mechanism configured to attach to a container of the plurality of containers using a pressure differential.

21. An apparatus for delivering a plurality of containers to a plurality of filling machines for filling of the containers with a substance, said apparatus comprising:

a feeding assembly comprising a first staging area aligned with a first filling machine of the plurality of filling machines for facilitating delivery of containers of the plurality of containers from said first staging area to the first filling machine, a second staging area aligned with a second filling machine of the plurality of filling machines for facilitating delivery of containers of the plurality of containers from said second staging area to the second filling machine, and a receiving area adjacent a supply of the plurality of containers, wherein said feeding assembly is configured to move containers of the plurality of containers from said receiving area to said first staging area and to move containers of the plurality of containers from said receiving area to said second staging area, and wherein each of said first and second staging areas are configured to receive containers of the plurality of containers from said receiving area; and a transfer assembly configured to remove a container of the plurality of containers from at least one of said first and second staging areas of said feeding assembly and deliver the container to at least one of said first and second filling machines, wherein the plurality of containers each include an opening having an open position and a closed position, said transfer assembly comprising a biasing mechanism configured to hold the opening in the open position during delivery of a container of the plurality of containers to at least one of said first and second filling machines.

22. The apparatus of claim 21, wherein the biasing mechanism comprises a spring.

23. The apparatus of claim 21, wherein the biasing mechanism is configured to squeeze opposite edges of an end portion of a container of the plurality of containers towards each other to hold the opening in the open position.

24. The apparatus of claim 23, wherein the biasing mechanism comprises two members biased at least partially toward each other.

25. A method for delivering a plurality of containers to a plurality of filling machines for filling the plurality of containers with a substance, said method comprising:

loading a first container of the plurality of containers onto a receiving area of a feeding assembly having a first staging area and a second staging area, wherein the feeding assembly is configured to move containers of the plurality of containers from the receiving area to the first and second staging areas;

guiding the first container into the first staging area;

removing the first container from the first staging area;

delivering the first container to a first filling machine of the plurality of filling machines;

loading a second container of the plurality of containers onto the receiving area of the feeding assembly;

guiding the second container into the second staging area;

removing the second container from the second staging area; and delivering the second container to a second filling machine of the plurality of filling machines, wherein the plurality of containers each include an opening having an open position and a closed position, and said delivering the first container to a first filling machine comprises holding the opening in the open position using a biasing mechanism.

* * * * *